US005155349A

United States Patent [19]

Roehrich et al.

[11] Patent Number: 5,155,349

[45] Date of Patent: Oct. 13, 1992

[54] X-RAY IMAGE INTENSIFIER WITH SHRINK-FITTING PARTS

[75] Inventors: Heinz Roehrich, Erlangen; Walter Greschat; Fritz-Wilhelm Lange, both of Buckenhof; Silvester Schweda, Bubenreuth, all of Fed. Rep. of Germany

[73] Assignee: Siemens Aktiengesellschaft, Munich, Fed. Rep. of Germany

[21] Appl. No.: 618,417

[22] Filed: Nov. 27, 1990

[30] Foreign Application Priority Data

Nov. 28, 1989 [EP] European Pat. Off. ..... 89121922.2

[51] Int. Cl.[5] ..... H01J 31/50

[52] U.S. Cl. ..... 250/213 VT; 250/492.1

[58] Field of Search ..... 250/213 R, 213 VT, 492.1; 313/523, 526, 541, 630

[56] References Cited

U.S. PATENT DOCUMENTS

| | | | |
|---|---|---|---|
| 3,849,690 | 11/1974 | Cosco et al. | 313/630 |
| 4,122,967 | 10/1978 | Roehrich | 313/420 |
| 4,363,162 | 12/1982 | Price | 250/492.1 |
| 4,401,729 | 8/1983 | Claussen et al. | 428/623 |

FOREIGN PATENT DOCUMENTS

| | | |
|---|---|---|
| 2461265 | 6/1976 | Fed. Rep. of Germany . |
| 2619507 | 5/1978 | Fed. Rep. of Germany . |
| 58-18848 | 4/1983 | Japan . |

*Primary Examiner*—David C. Nelms

*Attorney, Agent, or Firm*—Hill, Van Santen, Steadman & Simpson

[57] ABSTRACT

An x-ray image intensifier has a housing, an input screen, an output screen, and a number of electrodes for the electron optics, the housing including a number of joined parts and at least one of those parts consisting of electrically insulating material. The part or parts of the housing consisting of insulating material have seating surfaces to which parts, such as the electrodes, are secured by shrinking.

9 Claims, 1 Drawing Sheet

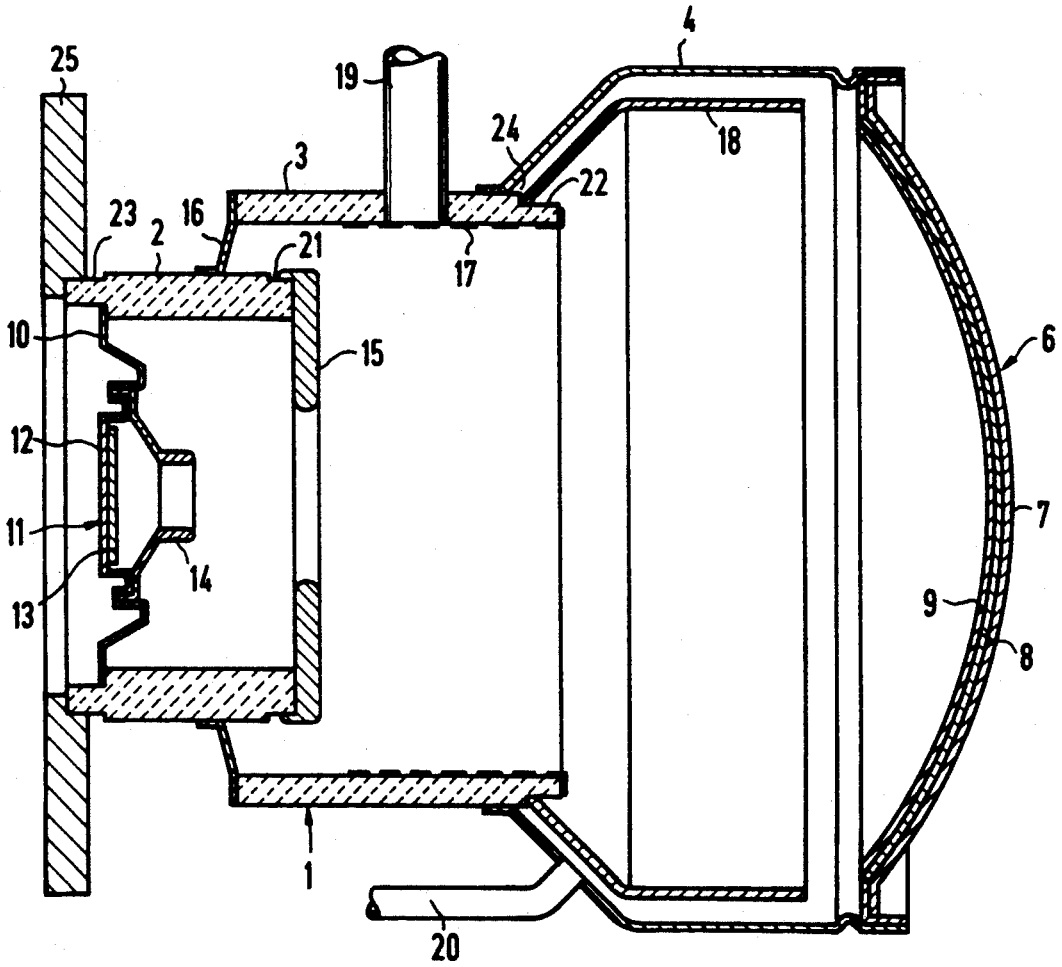
25
19
4
24
18
3
22
23
2
16
21
17
10
15
6
12
7
11
14
13
9
8
1
20

X-RAY IMAGE INTENSIFIER WITH SHRINK-FITTING PARTS

BACKGROUND OF THE INVENTION

1. Field of the Invention

The present invention is directed to an x-ray image intensifier having a multi-part housing, wherein one of the housing parts consists of electrically insulating material.

2. Description of the Prior Art

Conventional x-ray image intensifiers generally include a housing, an input screen, an output screen and a plurality of electrodes for the electron optics. It is known to construct the housing from a plurality of joined parts, with at least one of the housing parts consisting of electrically insulating material. Such x-ray image intensifiers convert and intensify an incoming x-ray image into a visible light image.

Such an x-ray image intensifier is disclosed in German AS 26 19 507 wherein the housing consists of two housing parts. The housing part facing the output screen, and which surrounds the anode and the high voltage electrodes, consists of ceramic, and the other housing part consists of stainless steel. In this known x-ray image intensifier, the electrodes are mounted on spacers which extend through the ceramic housing part. This known x-ray image intensifier has the disadvantage that many components must be assembled during manufacture of the x-ray image intensifier, so that it is extremely expensive. Moreover, the electrodes must be mounted and adjusted with great care.

SUMMARY OF THE INVENTION

It is an object of the present invention to provide an x-ray image intensifier having a multi-part housing wherein the number of components which must be assembled during manufacture of the intensifier is reduced so that manufacture is simplified.

It is a further object of the present invention to provide such an x-ray image intensifier wherein the electrodes can be mounted without adjustment.

The above object is achieved in an x-ray image intensifier wherein the housing parts consisting of electrically insulating material are provided with seating surfaces to which parts are secured by shrinking. As a result, for example, the holders required in conventional devices for mounting the electrodes are not needed. An optimally aligned electrode system is obtained without adjustment by precisely defining the location of the seating surfaces and by using precisely manufactured, mechanically stable electrodes.

An especially simple and stable structure is achieved in an embodiment wherein the parts which are secured by shrinking are the electrodes. A stable mounting of the x-ray image intensifier, as well as the optics and video chain following the intensifier, is achieved in an embodiment wherein the support mount is secured by shrinking. The electrically insulating parts preferably consist of ceramic, for example, aluminum oxide, and the parts attached by shrinking preferably consist of metal, for example aluminum alloy.

A simple structure insofar as the appropriate selection and shaping of the parts of the housing is achieved in an embodiment wherein the housing has a first, tubular housing part consisting of ceramic which is disposed in the region of the output screen, and wherein the carrier for the output screen is attached to one end of the first housing part and a first electrode is attached by shrinkage to the other end of the first housing part. A second tubular housing part consisting of ceramic is attached vacuum-tight to the first housing part in the region of the first electrode, and a further electrode is secured to the opposite end of the second housing part. Further components can be eliminated by coating the second housing part with a second electrode at the interior wall of the second housing part. The number of parts can be further reduced by constructing the housing of a single housing part consisting of insulating material having an interior wall on which a plurality of electrodes are created by vapor-deposition.

DESCRIPTION OF THE DRAWINGS

The single FIGURE is a side sectional view of an x-ray image intensifier constructed in accordance with the principles of the present invention.

DESCRIPTION OF THE PREFERRED EMBODIMENTS

The x-ray image intensifier constructed in accordance with the principles of the present invention shown in the drawing has a housing 1 consisting of two ceramic housing parts 2 and 3, and a metallic housing part 4. The housing 1 expands in diameter from the first ceramic housing part 2 to the metallic housing part 4. The metallic housing part 4 may consist of stainless steel, for example, Vacon, and the ceramic housing parts 2 and 3 may consist of aluminum oxide.

The input screen 6, which forms the termination of the tube housing at the input side, has a luminescent layer 8 and a photocathode 9 attached to an aluminum carrier 7. The aluminum carrier 7 is secured in a known manner to the metallic housing part 4. The luminescent layer 8 may consist, for example, of cesium iodide (CsI).

At the opposite end of the intensifier, a carrier 10 for the output screen 11 is hard-soldered to the housing part 2 within the opening of the housing part 2. The output screen 11 comprises an optically transparent pane 12, having an interior side on which a luminescent layer 13 is applied. The anode 14 is also secured to the carrier 11.

The first ceramic housing part 2 is essentially tubular. At the side thereof facing away from the output screen 11, a seating surface 21 is provided onto which the first electrode 15 is attached by shrinking, accomplished by heating the electrode 15 and subsequent cooling thereof. The first electrode 15 may consist of an aluminum alloy, and is essentially in the form of a disc having a central aperture therein, and an exterior edge terminating in a thickened portion which rests on the seating surface 21.

The first ceramic housing part 2 has an annular flange 16 in the proximity of the seating surface 21 for the first electrode 15, and the second ceramic tubular housing part 3 is joined to the first housing part 2 by soldering the annular flange 16 thereto. The second housing part 3 has an interior surface coated with a layer forming a second electrode 17 in the region just beyond the first electrode 15.

The second housing part 3 has two seating surfaces 22 and 24 at its exterior side facing away from the output screen 11. A third electrode 18 is attached by shrinking on the seating surface 22 disposed closest to the edge of the second housing part 3. The electrode 18 also consists of an aluminum preform. The electrode 18 is plugged onto the front region of the housing part 3, from which it increases in diameter in a conical region followed by an annular region.

The metallic housing part 4, which carries the input luminescent screen, is soldered to the other seating surface 24.

The housing parts 3 and 4 are provided with bores which respectively accept a pump connection 19 for connection to a vacuum pump, and a getter connection 20 for the getter pump.

The ceramic housing part 2 has a seating surface 23 to which a mount 25 is attached by shrinking in the region of the output screen 11. The mount 25 has a central opening surrounding the seating surface 23 and provides a means for fastening the x-ray image intensifier in a larger housing (not shown). The mount 25 may consist of metal, however, it may consist of any type of material which can be attached by shrinking.

The exterior connection of the electrode 15 occurs via the metallization of the soldered joint, the external connection for the electrode 17 ensues via the pump connection 19, and ensues for the electrode 18 via a vacuum-tight lead-through (not shown). The photocathode 9 and the anode 14 are provided with electrical contacts to the exterior respectively via the metal parts 4 and 10 of the housing 1 connected to those components.

The structure shown in the drawing can therefore be produced with few parts. All fastening and holding means for the electrodes are eliminated, and only one lead-through for the electrodes is required, thereby reducing the susceptibility of the intensifier to leaks. Given precise dimensioning, the shrink-on technique results in electrodes which are disposed at an exactly defined location, so that subsequent adjustment is not necessary.

The simplified structure and the reliable fastening technique guarantee an extremely vibration-proof system. The materials (metal and ceramic) which are used insure a substantially break-proof tube.

Instead of using ceramic for the housing parts 2 and 3 consisting of insulating material, porcelain or glass may be used onto which the electrodes are either applied by shrinking or by vapor-deposition. Instead of using a number of insulating housing parts, it is also possible to use only a single housing part, to which the electrodes are applied either by shrinking or by vapor-deposition.

Although further modifications may be suggested by those skilled in the art, it is the intention of the inventors to embody within the patent warranted hereon all changes and modifications as reasonably and properly come within the scope of their contribution to the art.

We claim as our invention:

1. An x-ray image intensifier comprising;

a housing consisting of a plurality of joined parts with at least one of the housing parts consisting of electrically insulating material;

an input screen and an output screen connected to said housing;

an electron optics system having a plurality of electrodes; and said at least one housing part consisting of insulating material having seating surfaces thereon to which parts are secured by shrinking.

2. An x-ray image intensifier as claimed in claim 1 wherein said electrodes are secured to said at least one housing part by shrinking.

3. An x-ray image intensifier as claimed in claim 1 wherein a mount for said x-ray image intensifier is attached to said at least one housing part by shrinking.

4. An x-ray image intensifier as claimed in claim 1 wherein said at least one housing part consists of ceramic.

5. An x-ray image intensifier as claimed in claim 1 wherein said parts attached to said at least one housing part by shrinking consist of metal.

6. An x-ray image intensifier as claimed in claim 5 wherein said parts attached by shrinking consist of an aluminum alloy.

7. An x-ray image intensifier as claimed in claim 1 wherein said housing consists of a first tubular housing part consisting of ceramic in the region of said output screen, and further comprising a carrier for said output screen attached by shrinking to said first tubular housing and a first of said electrodes attached by shrinking at an opposite end of said first housing part, and further comprising a second tubular housing part consisting of ceramic attached to said first housing part in the region of said first electrode, and having a a second of said electrodes attached to said second housing part by shrinking at an opposite end of said second tubular housing part.

8. An x-ray image intensifier as claimed in claim 7 wherein said second housing part has an interior wall with a coating thereon forming a third of said electrodes.

9. A method for manufacturing an x-ray image intensifier having metallic parts comprising the steps of:

joining a plurality of housing parts to form a housing in which an input screen and an output screen and electron optics are disposed, at least one of said housing parts consisting of insulating material; and attaching at least some of said metallic parts to said at least one housing part by shrinking said metallic parts to tightly abut said at least one housing part.

* * * * *